US005528349A

United States Patent [19]

Satake

[11] Patent Number: 5,528,349

[45] Date of Patent: Jun. 18, 1996

[54] DEVELOPER CONTAINER FOR STABLY REPLENISHING DEVELOPER TO DEVELOPING DEVICE

[75] Inventor: Shunsuke Satake, Kawanishi, Japan

[73] Assignee: Minolta Co., Ltd., Osaka, Japan

[21] Appl. No.: 313,763

[22] Filed: Sep. 28, 1994

[51] Int. Cl.[6] ..... G03G 15/06

[52] U.S. Cl. ..... 355/260; 222/DIG. 1

[58] Field of Search ..... 355/260; 222/DIG. 1, 222/167–169

[56] References Cited

U.S. PATENT DOCUMENTS

| | | | |
|---|---|---|---|
| 4,212,264 | 7/1980 | Knechtel et al. | 222/DIG. 1 |
| 4,641,945 | 2/1987 | Ikesue, et al. | 355/260 |
| 4,878,603 | 11/1989 | Ikesue et al. | 222/DIG. 1 |
| 5,296,900 | 3/1994 | Saijo et al. | 355/260 |

FOREIGN PATENT DOCUMENTS 6-102758 4/1994 Japan .

*Primary Examiner*—William J. Royer

*Attorney, Agent, or Firm*—Willian Brinks Hofer Gilson & Lione

[57] ABSTRACT

A developer container has a cylindrical container body with a bottom end and an open end and a cap closing the open end of the container body. The developer container has a spiral rib, a outlet opening and a bank portion. The spiral rib is formed on the inner surface of the container body. The outlet opening is formed on the side surface in vicinity of one end of the container body, whereby the rotation of the container disposed horizontally causes a developer contained in the container to move to one end of the container along the spiral rib and to flow out through the outlet opening. The bank portion is formed on the inner surface at the upstream side of the outlet opening with respect to the rotational direction of the container, the bank portion being positioned in the vicinity of the outlet opening and being continuous with the terminate end of the spiral rib.

10 Claims, 9 Drawing Sheets

DEVELOPER CONTAINER FOR STABLY REPLENISHING DEVELOPER TO DEVELOPING DEVICE

BACKGROUND OF THE INVENTION

1. Field of the Invention

The present invention relates to a developer container for replenishing a developer to a developing device of an image forming apparatus such as a copying machine, printer or the like.

2. Description of the Prior Art

An image forming apparatus is provided with a developer container removable therefrom for periodically replenishing a developer to a developing device. The developer container, as disclosed in U.S. Pat. No. 5,296,900, U.S. Pat. No. 4,641,945 or the like, is a cylindrical bottle having a spiral rib on the internal surface and an outlet opening on the side surface at the one end of the bottle, in which the developer is contained. The open end of the container is sealed with a cap. The outlet opening of the container is closed by a sealing film glued to the edge of the outlet opening.

The developer container is mounted horizontally on the image forming apparatus such as a copying machine. Then, the sealing film is tore off. The rotation of the container allows the developer within the container to move toward the end of the container along the spiral rib and to flow out through the outlet opening. Thereby, the developer is periodically replenished to the developing device at every one rotation of the developer container.

The developer container, however, has a disadvantage that the developer is not replenished stably. The reason is that although a constant quantity of developer is replenished through the outlet opening while a large quantity of developer is contained within the container, the quantity of the developer replenished from the container becomes smaller as the developer contained within the container reduces gradually.

Therefore, some type of developer container for stably replenishing the developer to the developing device has been proposed so far.

Japanese Laying-open Patent Publication No. 6-102,758 discloses a developer container which is provided with an enclosure portion surrounding the outlet opening of the container. The enclosure portion has a opening part such that a constant quantity of the developer scooped by the opening part of the enclosure portion can be dropped through the outlet opening and replenished to the developing device. The developer container has a disadvantage that the construction of the enclosure portion is complicated and is not suitable for a blow molding method. The container has a further disadvantage that a large quantity of the developer remains within the container without being scooped by the enclosure portion when the developer is running short.

U.S. Pat. No. 5,296,900 (especially in FIG. 21) discloses a developer supplying container on the side surface of which an outlet opening is disposed such that the opening is close to the spiral rib at the terminal end thereof. The container is intended to effectively lead developer remaining in the container to the outlet opening along the spiral rib. In this container, however, all the developer is not always dropped through the outlet opening because a part of the developer away from the spiral rib is not led to the outlet opening. This means that the quantity of replenishing developer becomes unstable and that it is not possible to eliminate the above described disadvantage i.e. a waste of developer due to the remains within the container.

In the aforementioned developer containers, a vibration or swing motion perpendicular to the longitudinal axis of the container is applied to the container during the rotation thereof such that the developer within the container flows out smoothly through the outlet opening. Such developer containers have a disadvantage that it is necessary to increase the rotational torque of the container.

Moreover, the above developer containers have a disadvantage that the cylindrical body is likely to cause the container to roll when the container is placed on the table or floor at the time of maintenance or inspection, whereby the developer is spilt thereon through the outlet opening to soil the surroundings.

SUMMARY OF THE INVENTION

The present invention has been developed to substantially eliminate the above-described disadvantages.

It is a first object of the present invention to provide a developer container which is capable of stably replenishing the developer to the developing device even if the developer within the container is running short.

It is a second object of the present invention to provide a developer container in which the increase of rotational torque due to the vibration or swing motion applied to the container body for smooth discharge of the developer can be suppressed.

It is a third object of the present invention to provide a developer container which does not roll when being placed on the table or floor, whereby the developer is not spilt thereon.

It is a fourth object of the present invention to provide a developing apparatus having such a developer container.

In order to achieve the aforementioned first object, there is provided a developer container having a cylindrical container body with a bottom end and an open end and a cap closing the open end of the container body, the developer container comprising:

- a spiral rib formed on the inner surface of the container body;
- an outlet opening formed on the side surface in vicinity of one end of the container body, whereby the rotation of the container disposed horizontally causes a developer contained in the container to move to one end of the container along the spiral rib and to flow out through the outlet opening; and
- a bank portion formed on the inner surface at the upstream side of the outlet opening with respect to the rotational direction of the container, the bank portion being positioned in the vicinity of the outlet opening and being continuous with the terminate end of the spiral rib.

According to the invention, the developer in the container moves along the spiral rib as the container rotates. The developer which has arrived at the end of the container is dammed up by the bank portion to flow out through the outlet opening and then is replenished to a developing device. Since the bank portion is continuous with the spiral rib, the developer is reliably led to the bank portion along the spiral rib to arrive at the outlet opening. Therefore the developer is stably replenished even if the developer is running short. The quantity of the developer remaining in the container is reduced, thereby there becomes no waste of the developer.

In a preferred embodiment of the present invention, the spiral rib may be integrally formed with the internal surface of the container body. The bank portion may be also integrally formed with the internal surface of the container body. Such containers can be easily formed by means of a blow molding method.

Preferably, one face of the bank portion opposite to the outlet opening is perpendicular to the inner surface of the container body, while the other face of the bank portion is sloped gently with respect to the inner surface of the container body.

In order to achieve the aforementioned second object, there is provided a developer container in which an uneven portion is formed on the outer circumferential surface of the container body, the uneven portion being engaged with a protruding portion provided on a support member of the container to cause the rotating container to move laterally periodically.

In a preferred embodiment of the present invention, the uneven portion comprises a step portion formed in the circumferential direction and an inclined portion gently connecting the step portion to the outer circumference surface of the container body.

According to the invention, the lateral movement of the container causes the container to vibrate or swing. This irregular movement allows the developer adhered to the internal surface of the container to drop off and allows the lump developer within the container to be broken down, which ensures that the developer in the container flows smoothly.

In order to achieve the aforementioned third object, there is provided a developer container in which a pair of protuberances protruding outwardly are provided at the opposite side of the outlet opening on the outer surface of the container body, the protuberances being positioned in circumferential direction apart from each other, whereby the protuberances prevent the container from rolling until the outlet opening of the container comes downward.

Therefore, even if the container is put on the table horizontally, there is no possibility that the developer in the container flows out through the outlet opening.

In order to achieve the aforementioned fourth object, there is provided a developing apparatus comprising a developing device which supplies a developer to a photoreceptor to visualize an electrostatic latent image formed on the photoreceptor, a developer container in which the developer is contained, the developer container having a cylindrical container body with a bottom end and an open end and a cap closing the open end of the container body, a coupling which retains one end of the container, a driving motor which rotates the container via the coupling, and a developer replenishing portion which replenishes the developer discharged from the container to the developing device, the developer container comprising:

a spiral rib formed on the inner surface of the container body;

an outlet opening formed on the side surface in vicinity of one end of the container body, whereby the rotation of the container disposed horizontally causes a developer contained in the container to move to one end of the container along the spiral rib and to flow out through the outlet opening; and a bank portion formed on the inner surface at the upstream side of the outlet opening with respect to the rotational direction of the container, the bank portion being positioned in the vicinity of the outlet opening and being continuous with the terminate end of the spiral rib.

Preferably, in this developing apparatus, a pair of projections are provided on the outer surface of the container body, when inserting the container to the coupling such that the projections can be engaged with U-shaped portions formed in the open end of the coupling, the projections being retained in the engaging condition with the U-shaped portions by snap fitting portions provided in the U-shaped portions, whereby the container being fixed to the coupling.

BRIEF DESCRIPTION OF THE DRAWINGS

Further objects and advantages of the present invention will become clear from the following description taken in conjunction with the preferred embodiments thereof with reference to the accompanying drawings.

DETAILED DESCRIPTION OF THE PREFERRED EMBODIMENTS

Figure 1:
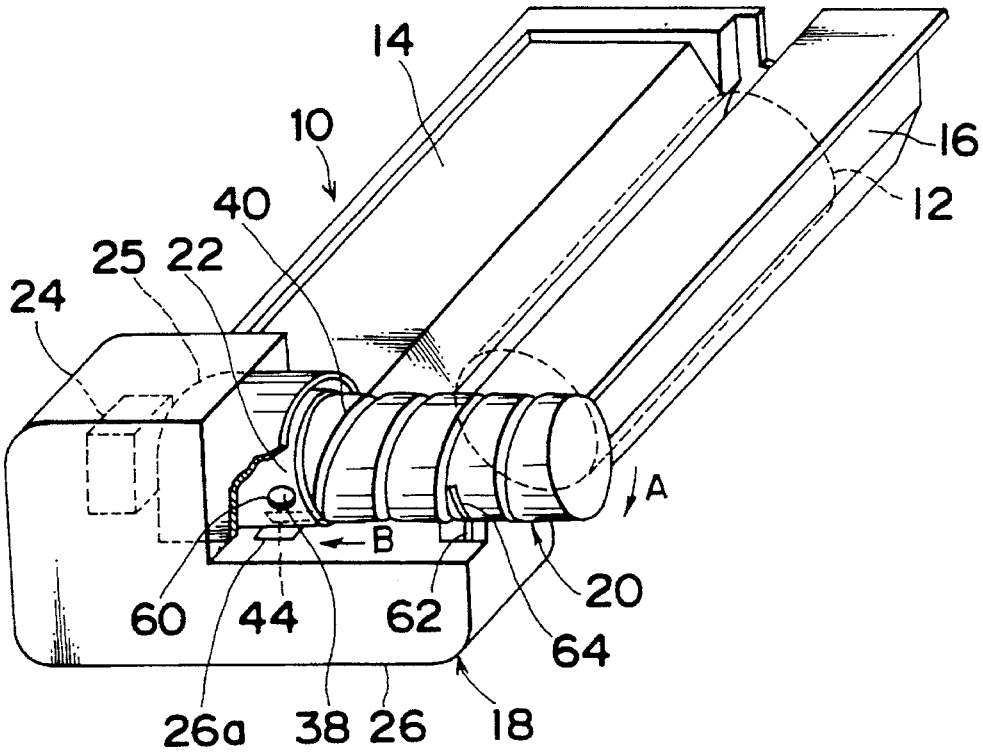
FIG.1 is a perspective view of the image forming apparatus with the developer container according to the present invention.

Referring to FIG. 1, there is shown an image forming unit 10 which is to be incorporated to an image forming apparatus such as a copying machine, printer or the like. The image forming unit 10 is constituted by a photoconductive drum 12 on the outer surface of which image information is exposed to form an electrostatic latent image, a developing device 14 which supplies a developer to the photoconductive drum 12 to visualize the electrostatic latent image, a cleaner 16 which removes the remaining developer on the outer surface of the photoconductive drum 12, a developer replenishing device 18 which replenishes the developer to the developing device 14 and so on.

The developer replenishing device 18 comprises a developer container 20 according to the present invention, a coupling 22 which retains one end of the container 20, a driving motor 24 which rotates the container 20 via the coupling 22, a holder 25 which supports the driving motor 24 and the coupling 22, and a developer replenishing portion 26 which replenishes the developer discharged from the developer container 20 to the developing device 14.

Figure 2:
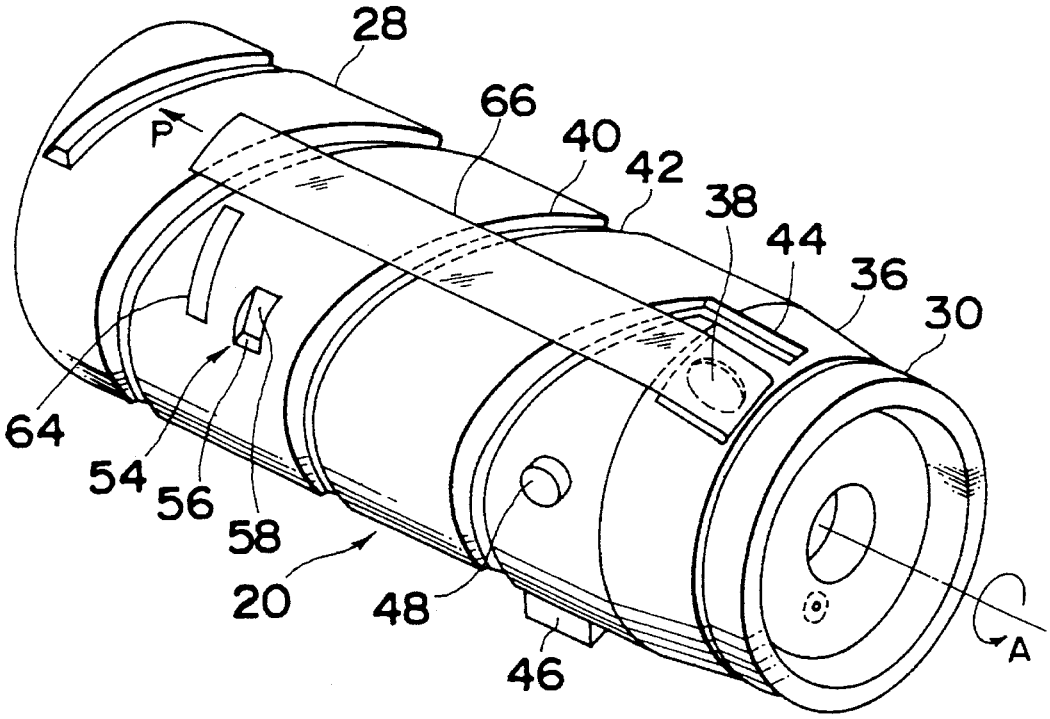
FIG.2 is a perspective view of the developer container according to the present invention.

The developer container 20 comprises, as shown in FIG. 2, a cylindrical container body 28 having a closed end and an open end, and a cap 30 which covers the open end of the container body 28.

Figure 3:
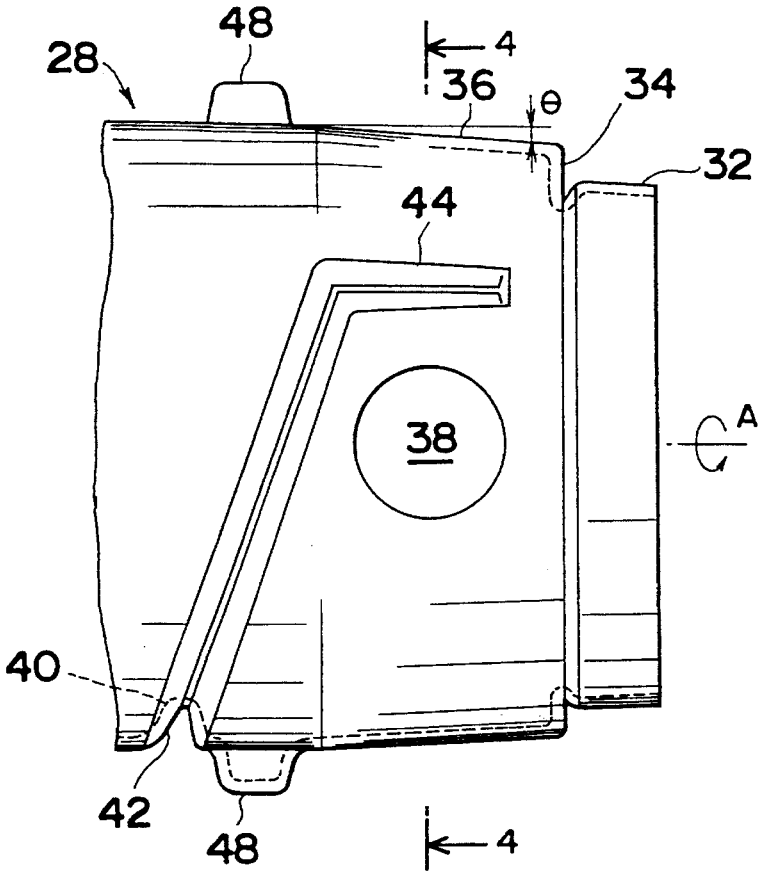
FIG.3 is an enlarged side view of the container of FIG. 2 showing the vicinity of the outlet opening.

The container body 28 is made of synthetic resin such as polyethylene, polystyrene, polypropylene or the like (preferably polyethylene) by means of a blow molding method. The container body 28 has, as shown in FIG. 3, a mouth 32, a shoulder 34 and a taper portion 36 tapered toward the shoulder 34 (in an angle of θ). There is provided an outlet opening 38 on the wall of the taper portion 36. The taper portion 36 allows the container 20 to be easily inserted into the coupling 22.

On the inner surface of the container body 28 is provided a spiral rib 40. Since the spiral rib 40 is formed by protruding the wall of the container body 28 to the internal direction, on the outer surface of the container body 28 corresponding to the spiral rib 40 is formed a spiral groove 42 having a V-shaped cross section. The spiral rib 40, as shown in FIG. 2, starts at the vicinity of the bottom end of the container body 28 and terminates at the vicinity of the outlet opening 38 close to the large diameter end of the taper portion 36.

On the inner surface at the upstream side of the outlet opening 38 with respect to the rotational direction A of the container 20 is provided a bank portion 44 protruding internally from the wall. The bank portion 44, as shown in FIG. 3, is positioned in the vicinity of the outlet opening 38 and is extended in the direction parallel to the axis of the container body 28 i.e. in the longitudinal direction. One end of the bank portion 44 terminates in the vicinity of shoulder 34, while the other end of the bank portion 44 is continuous with the terminal end of the spiral rib 40.

One end of the bank portion 44 may be more extended to be continuous with the shoulder 34. Preferably, as shown in FIG. 4, one face of the bank portion 44 opposite to the outlet opening 38 is perpendicular to the inner surface of the container body 28, while the other face of the bank portion 44 is sloped gently.

Figure 4:
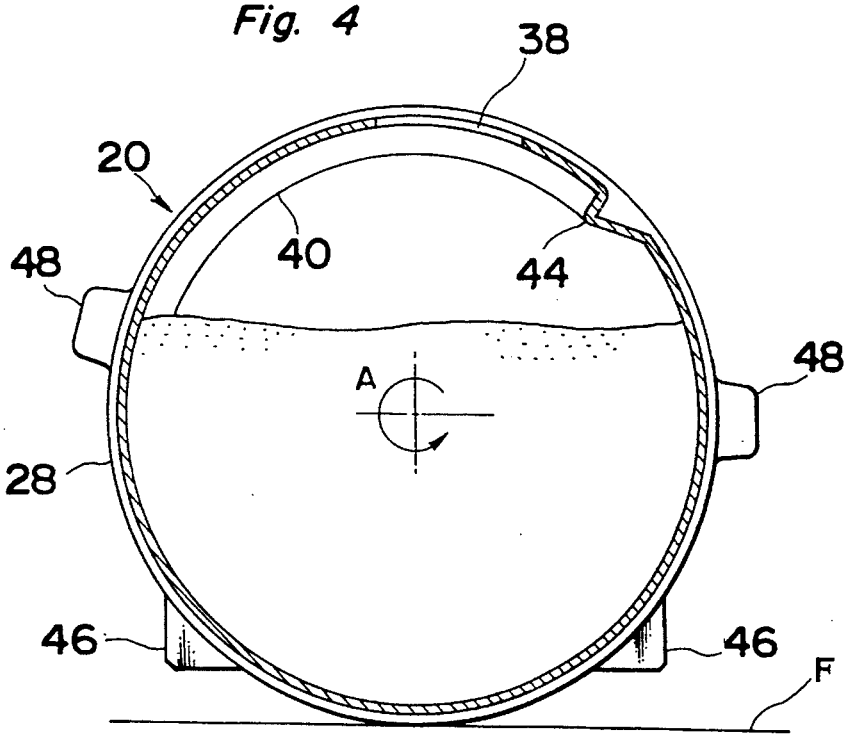
FIG.4 is a sectional view taken along line 4—4 of FIG. 3.

At the opposite side of the outlet opening 38 on the outer surface of the container body 28, as shown in FIG. 4, are provided a pair of protuberances 46 protruding outwardly. These protuberances 46 are positioned in a circumferential direction apart from each other. In case the developer container 20 is put on the table or floor F with the outlet opening 38 upward, the contact of any one of protuberance 46 with the table F prevents the container 20 from rolling. Therefore the developer within the container 20 is unlikely to flow out through the outlet opening 38.

Figure 5:
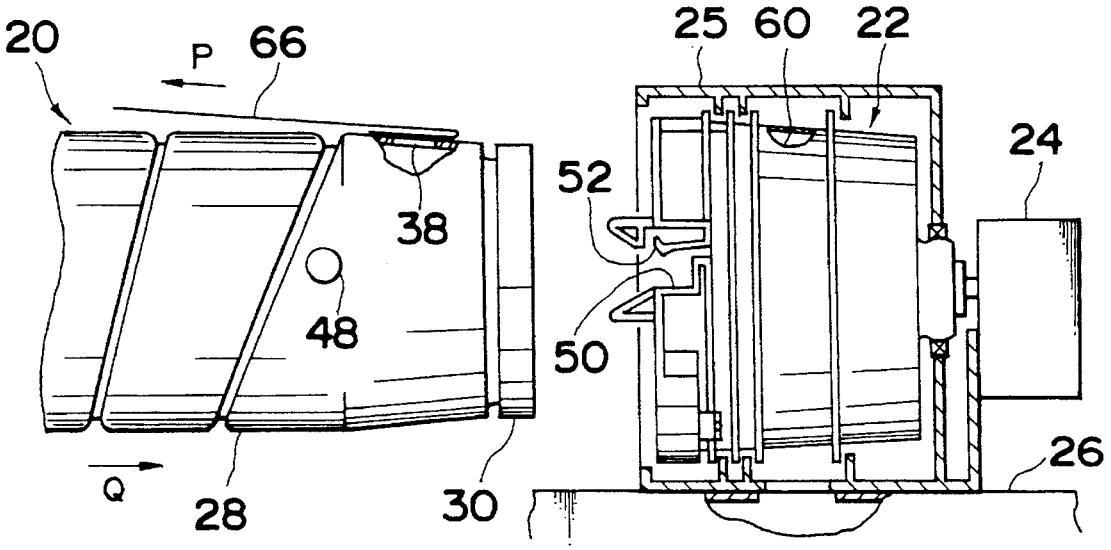
FIG.5 is a side view of the developer container according to the present invention showing the mounting condition.

Between each protuberance 46 and the outlet opening 38 is provided a cylindrical projection 48. Inserting the container 20 to the coupling 22 on the developer replenishing portion 26 such that the projections 48 can be engaged with U-shaped portions 50 formed in the open end of the coupling 22 as shown in FIG. 5, the projections 48 are retained in the engaging condition with the U-shaped portions 50 by snap fitting portions 52 provided in the U-shaped portions 50, whereby the container 20 is fixed to the coupling 22.

As shown in FIG. 2, on the outer surface close to the bottom of the container 20 is formed a recess 54. The recess comprises a step portion 56 formed in the circumferential direction and an inclined portion 58 gently connecting the step portion 56 to the outer circumference surface.

On the outer surface of the container body 28 is put a mark 64. When the container 20 is mounted in the coupling 22 as shown in FIG. 1, the mark 64 is aligned with a mate mark 62 put on the developer replenishing portion 26. As a result, the operator can recognize that the outlet opening 38 of the container body 28 overlaps with a hole 60 of the coupling 22 and that the mounting of the container 20 is finished. The mark 64 is provided by means of printing or forming a recess or projection.

As shown in FIG. 2, to the outer edge of the outlet opening 38 of the container body 28 is adhered a sealing film 66 of polypropylene by a hot melt bonding in order to close and seal the outlet opening 38. The sealing film 66 has a shape of a belt. One end portion of the sealing film 66 adhered to the edge of the outlet opening 38 is turned back to extend toward the bottom of the container body 28. The other end portion of the sealing film 66 is stuck suitably on the outer surface close to the bottom of the container body 28. Pulling the sealing film 66 in the direction of the arrow P to tear off the bonding portion, the outlet opening 38 can be opened.

This sealing film 66 is required not to be tore off due to a catch or collision during transportation of the container 20, while the sealing film 66 is requested to be easily removed during replacement work of the container 20.

Figure 6:
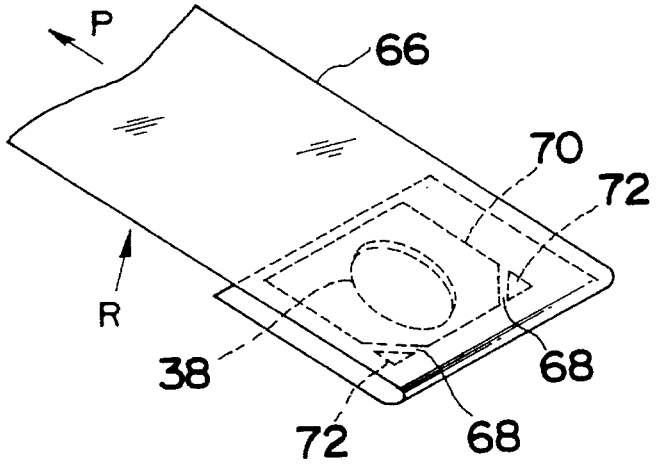
FIG.6 is an enlarged perspective view of the sealing film showing the attached condition to the outlet opening.

In this embodiment, as shown in FIG. 6, the hot melt bonding area of the sealing film 66 is rectangular. The rectangular bonding area is divided to a main bonding area 70 around the outlet opening 38 one end of which is tapered and two corner bonding areas 72 by providing non-bonding areas 68 at both corners of the tearing-off starting side.

Even if the sealing film 66 is pulled in the direction R by a catch or like during transportation, only the corner bonding area 72 is tore off, while the main bonding area 70 is not tore off because an impact is reduced by the non-bonding area 68. At the time of replacement of the container 20, since the tapered end of the main bonding area 70 is tore off at first, it is not so difficult to seal off the outlet opening 38.

Figure 7:
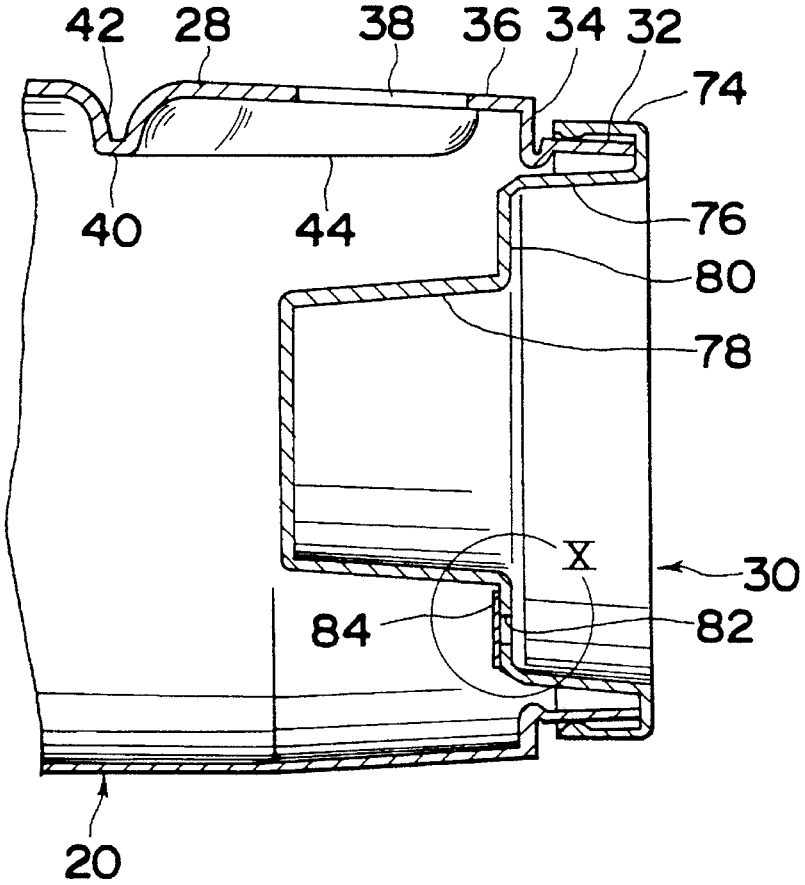
FIG.7 is an enlarged sectional view of the container of FIG. 2 showing the cap and the vicinity thereof.

The cap 30 is made of the same material of synthetic resin as the container body 28. The cap 30 is formed to enclose the mouth 32 of the container body 28. The cap 30 comprises, as shown in FIG. 7, an engagement portion 74 which is engaged with the outer circumferential surface of the mouth 32, an insert portion 76 which is inserted into the mouth 32 and which is positioned in the range between the end of the mouth 32 and the shoulder 34, an internal protruding portion 78 which has a diameter smaller than that of the insert portion 76 and has a cup-like configuration slightly tapered toward the tip and which is extended to the outlet opening 38 from the shoulder 34 of the container body 28, and a step portion 80 which is formed between the internal protruding portion 78 and the insert portion 76. The insert portion 76 of the cap 30 prevents the developer from accumulating inside the mouth 32. The internal protruding portion 78 restrains a large quantity of developer from gathering around the outlet opening 38.

In the step portion 80 of the cap 30 is formed a vent hole 82. The vent hole 82 is closed by a ventilation sheet 84 through which the air is capable of breathing but the developer is not capable of passing. By virtue of the ventilation sheet 84, the internal pressure of the container 20 is the same as an external atmospheric pressure. Therefore, even if an atmospheric pressure at the place that the developer is charged (at the factory site) is different from that at the place the container is used (at the user site), there is no possibility for the developer to blow off the outlet opening 38 immediately after the sealing film 66 is tore off. Since the ventilation sheet 84 is not capable of passing the developer, the developer in the container 20 does not leak out.

Figure 8:
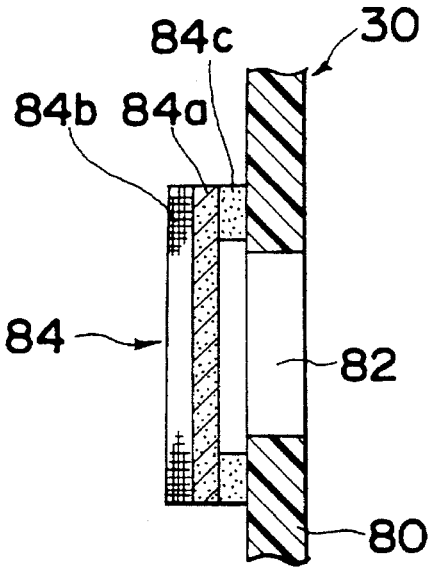
FIG.8 is an enlarged sectional view of the X portion in FIG. 7.

The vent hole 82 has a diameter of 1.2 mm. The ventilation sheet 84 has a diameter of 8 mm. The ventilation sheet 84, as shown in FIG. 8, comprises a porous membrane layer 84*a* of PTFE having a smaller hole diameter of 0.6 μm than a grain diameter of the developer (average 11 μm) and having a thickness of 25 μm and a woven cloth layer 84*b* of polyester fibre. The ventilation sheet 84 is glued to the edge of the vent hole 82 by means of a annular adhesive double coated tape 84*c*.

Even if the vent hole 82 is not provided in the cap 30, it would be also possible to prevent the developer from blowing off due to the pressure difference by means of utilizing a porous material for the sealing film 66 which closes the outlet opening 38 of the container body 28 so that the air can pass through the sealing film 66. In this case, however, since the sealing film 66 has a long length and a large area, utilizing a porous material such as the ventilation sheet 84 for the sealing film 66 causes the increase of cost. As the porous material such as the ventilation sheet 84 is easily tore off, the material is not suitable for sealing the outlet opening 38. In the previous embodiment (FIG. 2), therefore, the vent hole 82 is provided separately from the outlet opening 38.

The developer container 20 having the aforementioned constitution, with the cap 30 directed to the coupling 22 as shown in FIG. 5, is inserted into the coupling 22 in the direction of arrow Q so that the projections 48 can be engaged with the U-shaped portion 50, whereby the snap fitting portion 52 grips the projection 48 to fix the developer container 20. At this time, by checking whether or not the mark 64 of the container 20 is aligned with the mate mark 62 of the developer replenishing portion 26 as shown in FIG. 1, the operator can confirm that the container 20 is properly mounted on the developer replenishing portion 26.

Pulling the end of the sealing film 66 in the direction of arrow P while pushing the container 20 toward the coupling 22 in the direction of arrow Q, the sealing film 66 is tore off from the outlet opening 38. In this embodiment, the force of the snap fitting portion 52 holding the container 20 via the projection 48 is to be smaller than that required to tear off the sealing film 66. Therefore, even if the sealing film 66 is carelessly pulled without pushing the container 20 in the direction of arrow Q, only the container 20 is removed from the coupling 22, while the sealing film 66 is not tore off; thereby the developer does not leak out or flow out of the container 20.

The operation for replenishing the developer by employing the developer container of the present invention is described hereinafter.

The driving motor 24 drives the developer container 20 via the coupling 22 in the direction of arrow A in FIG. 1. The rotation of the developer container 20 causes the developer in the container 20 to flow on the internal circumferential surface of the container 20 in the reverse direction to the rotation direction A of the container 20 along the spiral rib 40 and to move toward the cap 30 from the bottom in the direction of arrow B.

Figure 9:
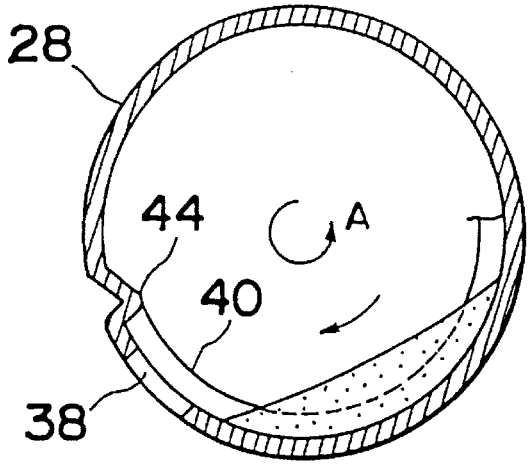
FIG.9 (A), (B) and (C) are sectional views showing the flowing condition of the developer in the developer container according to the present invention.
Figure 9:
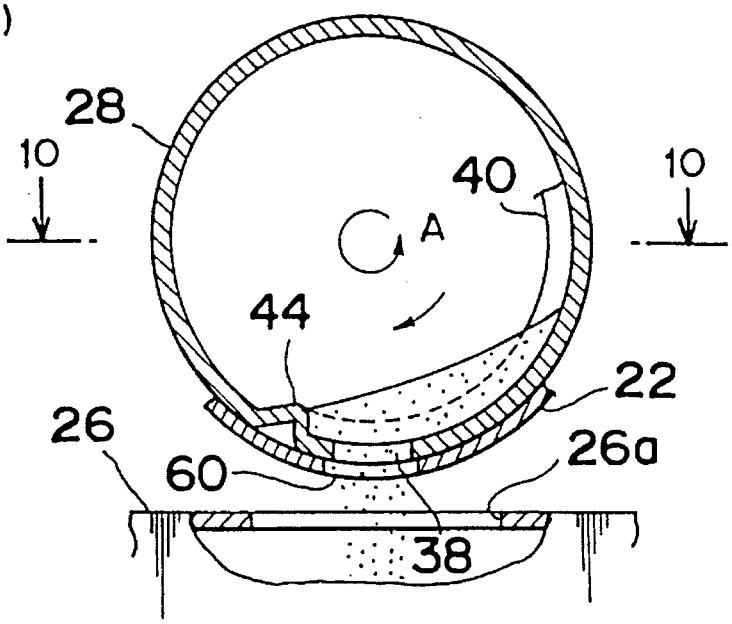
Figure 9:
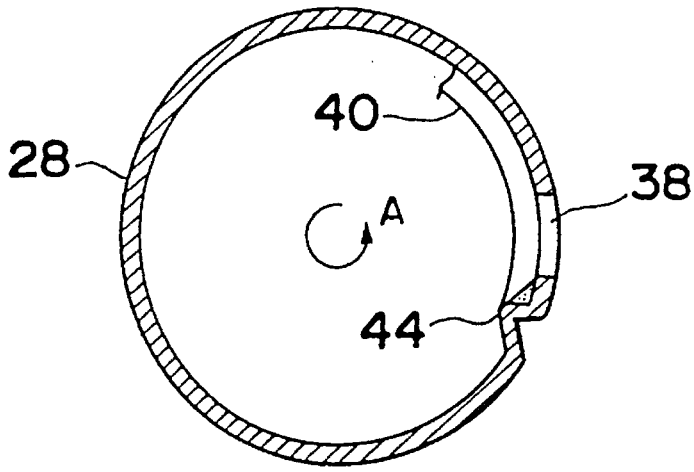

The developer arrives at the vicinity of the terminate end of the spiral rib 40 as shown in FIG. 9 (A). The developer flows out of the container 20 through the outlet opening 38 at the time that the outlet opening 38 becomes downward as shown in FIG. 9 (B). Then the developer drops into the developer replenishing portion 26 via the opening 60 of the coupling 22 and the hole 26*a* formed in the developer replenishing portion 26 to be replenished to the developing device 14. When the outlet opening 38 becomes upward as shown in FIG. 9 (C), the developer does not flow out of the container 20 through the outlet opening 38. Repeating this operation, the developer is replenished from the outlet opening 38 at every one rotation of the container 20.

Since the bank portion 44 is formed, as previously mentioned, on the inner surface at the upstream side of the outlet opening 38 with respect to the rotational direction A of the container 20 (at the downstream side with respect to the flow direction A' of the developer), the stream of the developer is dammed up by the bank portion 44 as shown in FIG. 9 (B). Therefore, whenever the developer in the container 20 is running short, almost all of the developer is dammed up by the bank portion 44 to flow out through the outlet opening 38. Thereby, not only the replenishment of the developer is stably performed, but also the quantity of the developer remaining in the container 20 is reduced.

Figure 10:
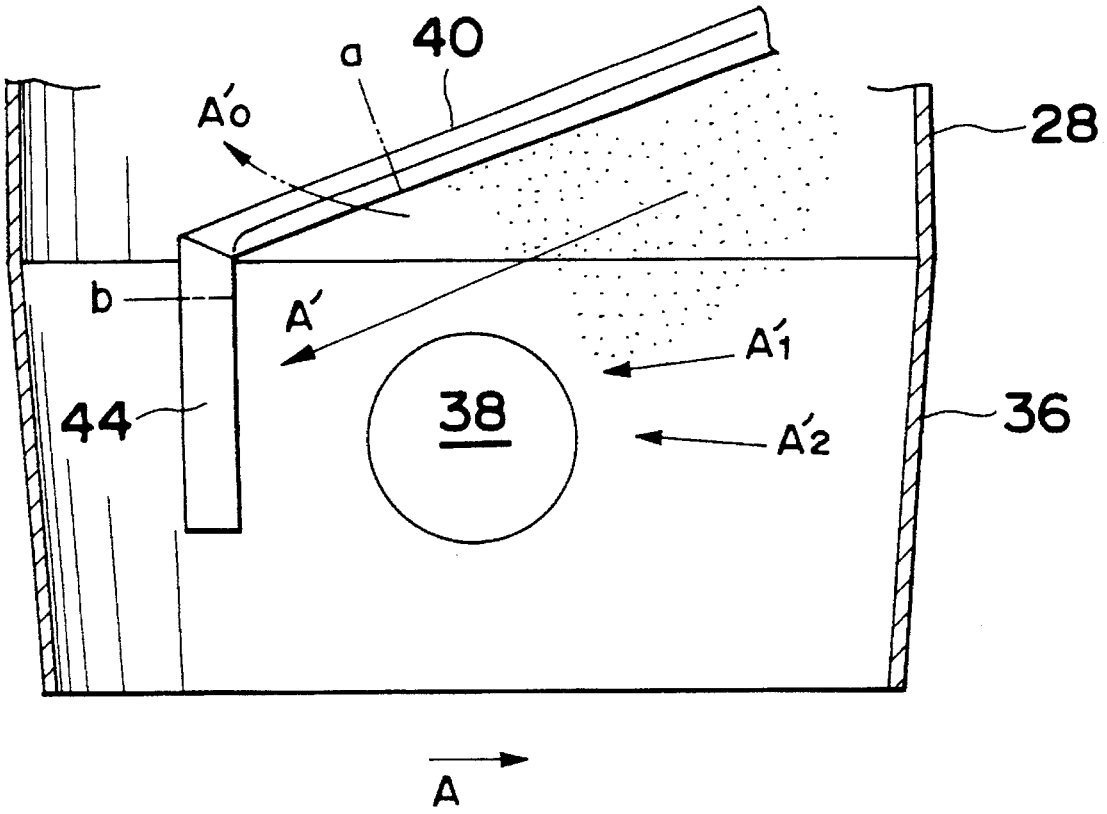
FIG.10 is an enlarged sectional view taken along line 10—10 of FIG. 9 (B) showing the flowing condition of the developer in the vicinity of the outlet opening of the developer container according to the present invention.

As the bank portion 44 is continuous with the spiral rib 40 as shown in FIG. 10, the developer moving along the spiral rib 40 in the direction of arrow A' is reliably led to the bank portion 44 and dammed up therein. The developer moving on the taper portion 36 apart from the spiral rib 40 changes the moving direction to become closer to the spiral rib 40 as shown in arrow $A'_1$, $A'_2$ and then joins the developer moving in the vicinity of the spiral rib 40 to be led to bank portion 44.

Suppose that the spiral rib 40 terminates at the point "a" or that the bank portion 44 terminates at the point "b", one part of the developer is pushed by the other part of developer flowing on the taper portion 36 in the direction of arrow $A'_1$, $A'_2$ to escape from the terminal course through the pass between the spiral rib 40 and the bank portion 44 toward the adjacent course as shown in arrow $A'_0$, thereby the developer remains in the container 20 without flowing out of the container 20. On the other hand, according to the present invention, as the bank portion 44 is continuous with the spiral rib 40, the developer is prevented from escaping as such, thereby the developer is reliably discharged from the container 20.

Figure 11:
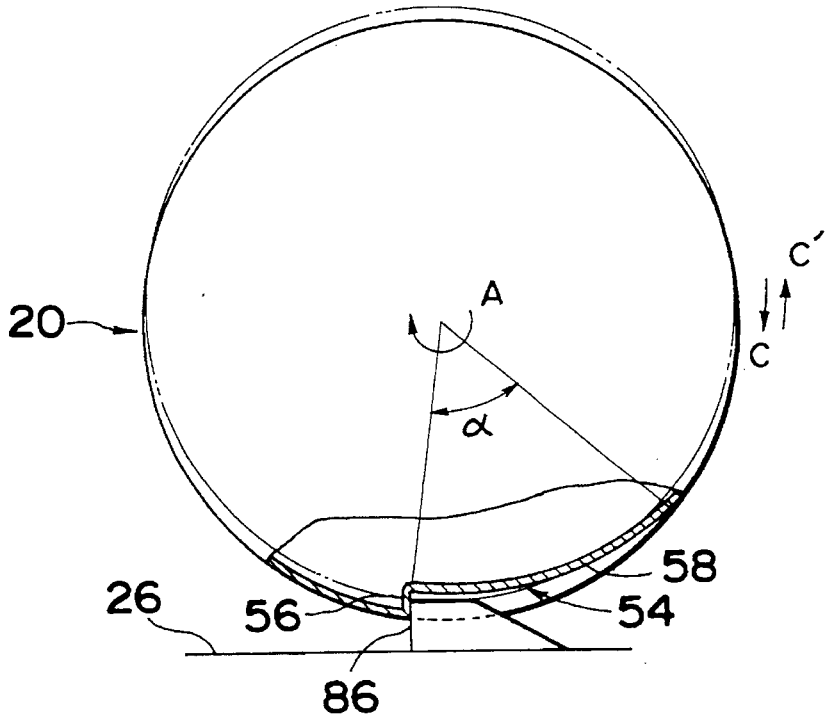
FIG.11 is a partially broken bottom end front view showing the lateral vibrating condition during the rotation of the developer container provided with the recess on the outer surface thereof according to the present invention.

During the rotation of the container 20, as shown in two-dot chain line in FIG. 11, a protruding portion 86 provided on the developer replenishing portion 26 normally comes in contact with the outer circumferential surface of the container 20. When the step portion 56 of the recess 54 formed on the outer surface of the container 20 passes through the protruding portion 86, the container 20 moves laterally as shown in arrow C from the condition shown in two-dot chain line to the condition shown in solid line according to the gravitation. Then, due to the further rotation of the container 20, the protruding portion 86 comes into contact with the circumferential surface of the container 20 through the inclined portion 58 of the recess 54, the container 20 moves laterally as shown in arrow C' to return to the normal condition in two-dot chain line. These operations are repeated during the rotation.

As a result, the container 20 moves laterally (vertically in this embodiment) at every one rotation, which causes the wall of the container 20 to vibrate or swing. Thereby, the developer lump in the container 20 is crushed, and the developer adhered to the spiral rib 40 or internal surface of the container 20 is shaken off. Then this developer is led to the outlet opening 38. This means that the smooth flow of the developer is ensured and that the quantity of the developer remaining in the container 20 is reduced.

Figure 12:
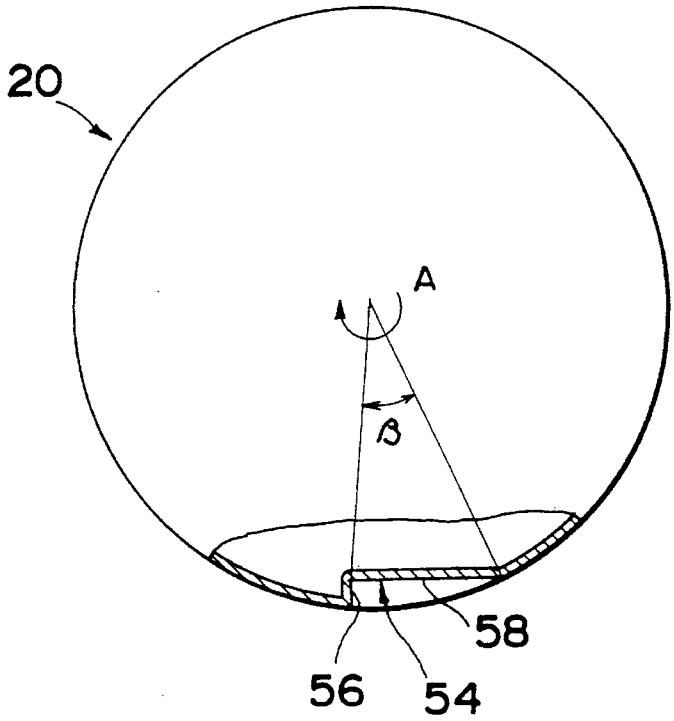
FIG.12 is a partially broken bottom end front view of the developer container provided with the modified recess of that of FIG. 11.

In the embodiment of the container 20 as shown in FIG. 11, the inclined portion 58 of the recess 54 is provided in a range of angle $\alpha$ from the step portion 56 and has a curved surface which is smoothly connected to the outer circumferential surface of the container 20 (Case A). In another embodiment of the container 20 as shown in FIG. 12, the inclined portion 58 of the recess 54 is provided in a range of angle $\beta$ (smaller than angle $\alpha$) from the step portion 56 and has a flat surface (Case B). The comparison with the rotational torque of both case A and case B when charging the developer having a weight of 650 g into the container 20 was made as follows.

Case A (FIG. 11); 1.4–1.6 Kgf cm

Case B (FIG. 12); 2.4–2.6 Kgf cm

As a result of this, the increase of the rotational torque required for the recess 54 of the container 20 to pass through the protruding portion 86 in Case A is smaller than that in Case B.

Figure 13:
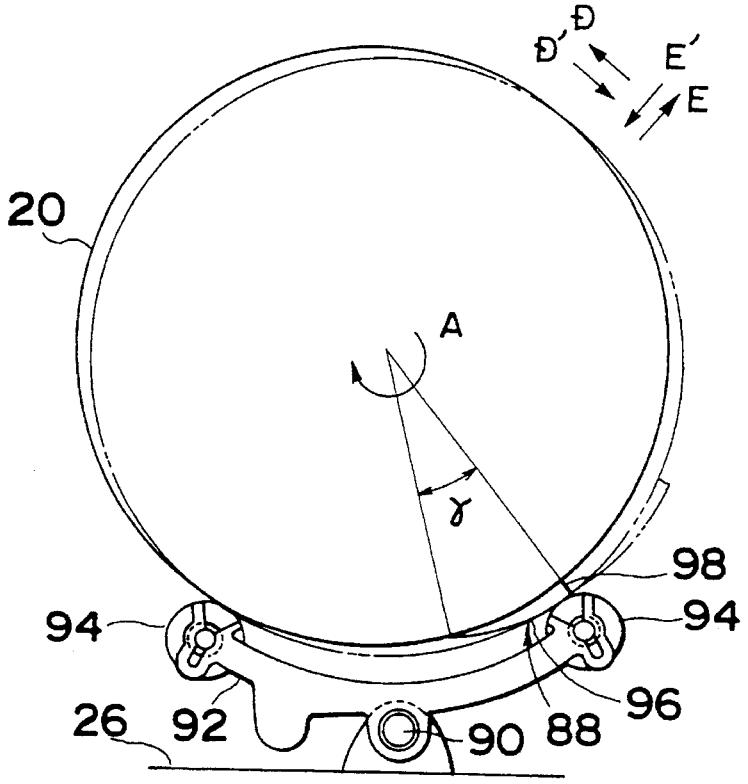
FIG.13 is a partially broken bottom end front view showing the lateral vibrating condition during the rotation of the developer container provided with the projection on the outer surface thereof according to the present invention.
Figure 14:
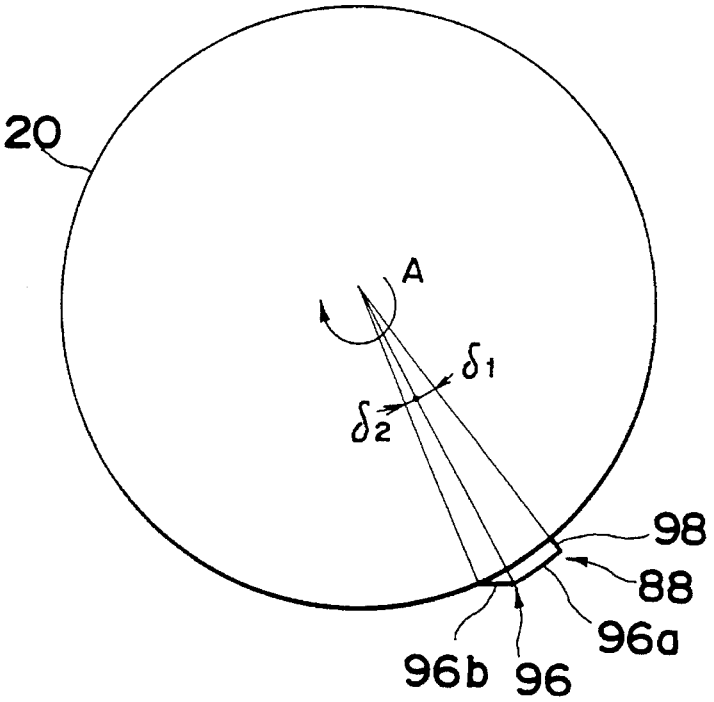
FIG.14 is a partially broken bottom end front view of the developer container provided with the modified projection of that of FIG. 13.

FIG. 13 and FIG. 14 shows still another embodiments of the container 20 in which protrusions 88 are formed on the outer circumferential surface of the container 20. On the developer replenishing portion 26 is provided a lever 92 which is capable of swinging around a pin 90. The lever 92 has a pair of rollers 94 at the both ends. The rollers 94 roll on the outer circumferential surface of the container 20 including the protrusion 88. In this embodiment, the container 20 moves laterally two times at every one rotation.

In the embodiment of the container 20 as shown in FIG. 13, the slant portion 96 of the protrusion 88 is provided in a range of angle $\gamma$ from the step portion 98 and has a curved surface which is smoothly connected to the outer circumferential surface of the container 20 (Case C). In another embodiment of the container 20 as shown in FIG. 14, the inclined portion 96 of the protrusion 88 comprises a cylindrical surface **96*a* provided in a range of angle $\delta_1$ from the step portion 98 and a flat surface 96*b* in a range of angle $\delta_2$ between the cylindrical surface 96*a* and the outer circumferential surface of the container 20 (Case D). The rotational torque of both case C and case D when charging the developer having a weight of 1800 g into the container 20** was as follows.

Case C (FIG. 13); 1.8 Kgf cm

Case D (FIG. 14); 3 Kgf cm

Figure 15:
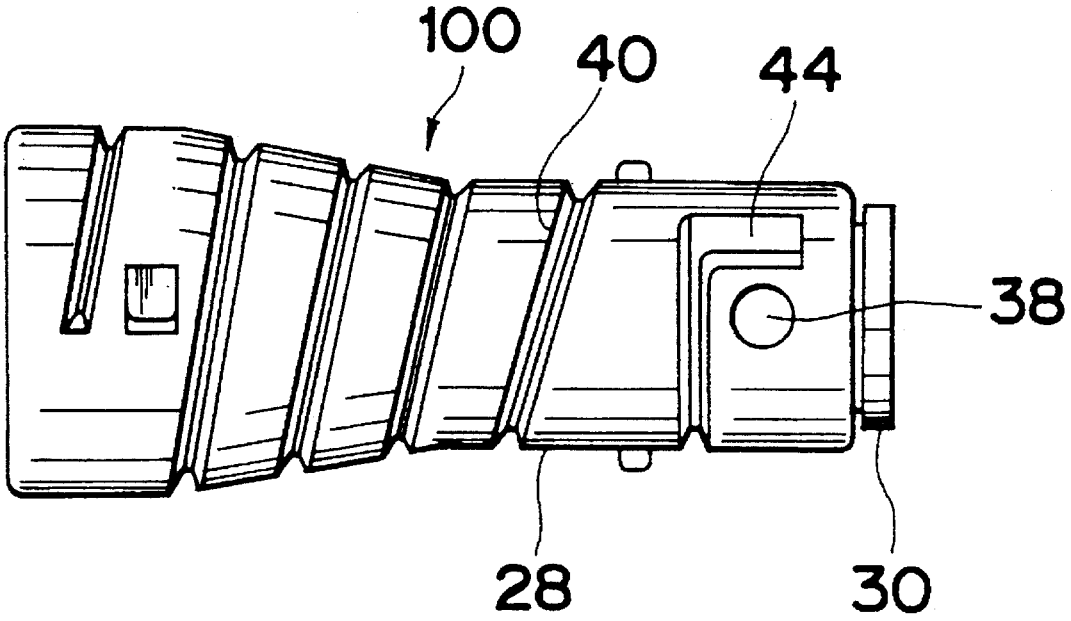
FIG.15 is a side view of the developer container having the cone-like cylindrical body according to the present invention.

Although the container body 28 except for the taper portion 36 is a straight circular cylinder in the above described embodiment, it may be a circular cone like a container body 28 of a developer container 100 shown in FIG. 15.

Although the spiral rib 40 and the bank portion 44 are integrally formed with the container body 28 by means of the blow molding method in the aforementioned embodiment, these may be formed by attaching separate parts to the internal surface of the container 20. Especially the spiral rib 40 may comprise a spring or the like disposed in spiral on the internal surface of the container 20.

Although the present invention has been fully described by way of the examples with reference to the accompanying drawing, it is to be noted here that various changes and modifications will be apparent to those skilled in the art. Therefore, unless such changes and modifications otherwise depart from the spirit and scope of the present invention, they should be construed as being included therein.

What is claimed is:

1. A developer container having a cylindrical container body with a bottom end and an open end and a cap closing said open end of said container body, said developer container comprising:

a spiral rib formed on the inner surface of said container body;

an outlet opening formed on the side surface in vicinity of one end of said container body, whereby the rotation of said developer container disposed horizontally causes a developer contained in said container body to move to one end of said container body along said spiral rib and to flow out through said outlet opening; and a bank portion formed on the inner surface at the upstream side of said outlet opening with respect to the rotational direction of said developer container, said bank portion being positioned in the vicinity of said outlet opening and being continuous with the terminate end of said spiral rib.

2. A developer container as in claim 1, wherein said spiral rib is integrally formed with the internal surface of said container body.

3. A developer container as in claim 1, wherein said bank portion is integrally formed with the internal surface of said container body.

4. A developer container as in claim 2, wherein said bank portion is integrally formed with the internal surface of said container body.

5. A developer container as in claim 1, wherein one face of said bank portion opposite to said outlet opening is perpendicular to the inner surface of said container body, while the other face of said bank portion is sloped gently with respect to the inner surface of said container body.

6. A developer container as in claim 1, wherein an uneven portion is formed on the outer circumferential surface of said container body, said uneven portion being engaged with a protruding portion provided on a support member of said container body to cause said developer container to move laterally periodically.

7. A developer container as in claim 6, wherein said uneven portion comprises a step portion formed in the circumferential direction and an inclined portion gently connecting the step portion to the outer circumference surface of said container body.

8. A developer container as in claim 1, wherein a pair of protuberances protruding outwardly is provided at the opposite side of said outlet opening on the outer surface of said container body, said protuberances being positioned in circumferential direction apart from each other, whereby said protuberances prevent the container body from rolling until said outlet opening of said container body comes downward.

9. A developing apparatus comprising a developing device which supplies a developer to a photoreceptor to visualize an electrostatic latent image formed on said photoreceptor, a developer container in which the developer is contained, said developer container having a cylindrical container body with a bottom end and an open end and a cap closing said open end of said container body, a coupling which retains one end of said developer container, a driving motor which rotates said developer container via said coupling, and a developer replenishing portion which replenishes the developer discharged from said developer container to said developing device, said developer container comprising:

a spiral rib formed on the inner surface of said container body;

an outlet opening formed on the side surface in vicinity of one end of said container body, whereby the rotation of said developer container disposed horizontally causes a developer contained in said container body to move to one end of said container body along said spiral rib and to flow out through said outlet opening; and a bank portion formed on the inner surface at the upstream side of said outlet opening with respect to the rotational direction of said developer container, said bank portion being positioned in the vicinity of said outlet opening and being continuous with the terminate end of said spiral rib.

10. A developing apparatus as in claim 9, wherein a pair of projections are provided on the outer surface of said container body, when inserting said developer container to said coupling such that said projections can be engaged with U-shaped portions formed in the open end of said coupling, said projections being retained in the engaging condition with the U-shaped portions by snap fitting portions provided in said U-shaped portions, whereby the developer container is fixed to said coupling.

* * * * *